US006459414B1

(12) United States Patent
Lévis et al.

(10) Patent No.: US 6,459,414 B1
(45) **Date of Patent: *Oct. 1, 2002**

(54) DUAL-POLARIZED AND CIRCULAR-POLARIZED ANTENNAS

(75) Inventors: Kathia Lévis, Alymer; Apisak Ittipiboon, Kanata; Aldo Petosa, Nepean; Michel Cuhaci, Ottawa, all of (CA)

(73) Assignee: Her Majesty the Queen in right of Canada as represented by the Minister of Industry, Ottawa (CA)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/609,975

(22) Filed: Jul. 3, 2000

(51) Int. Cl.[7] ..... H01Q 13/00
(52) U.S. Cl. ..... 343/780; 343/785
(58) Field of Search ..... 343/780, 781 R, 343/754, 785, 797, 772, 700 MS, 786, 795, 793

(56) References Cited

U.S. PATENT DOCUMENTS 4,150,382 A * 4/1979 King ..... 343/754
5,486,837 A * 1/1996 Miller ..... 343/780

OTHER PUBLICATIONS

K. Lévis "Ka–band holographic antennas", Thesis submitted to the school of Graduate Studies and Research in partial fulfillment of the requirements for the degree of M.A.Sc. in Electrical Engineering, SITE, University of Ottawa, Sep. 1999.

P.F. Checcacci et al., "A Holographic VHF Antenna", IEEE Transactions on Antennas and Propagation, vol. AP–19, Mar. 1971, pp. 278–279.

k. Iizuka et al. proposed a traveling wave antenna constructed based on holographic techniques in "Volume–Type Holographic Antenna", IEEE Transactions on Antennas and Propagation, vol. AP–23, Nov. 1975, pp. 807–810.

W.J. Getsinger, "Elliptically Polarized Leaky–Wave Array", IRE Transactions on Antennas and Propagation, vol. AP–10, Mar. 1962, pp. 165–171.

A. Chan and M. Kharadly, "High Gain, Dual Frequency, Dual Polarization, Low Profile Antenna Design for Millimeter–Wave Communication Systems", Tenth International Conference on Antenna and Propagation, Apr. 14–17, 1997, Edinburgh, UK, pp. 1.390–1.393.

H. T. Hui, Y. A. Ho, and E. K. N. Yung, "A Cylindrical DR Rod Antenna Fed by Short Helix", IEEE AP–S International Symposium, Jul. 21–26, 1996, Baltimore, Maryland, USA, vol. 3, pp. 1946–1949.

C. S. Lee and V. Nalbandian, "Circularly Polarized Traveling–Wave Microstrip Antenna", IEEE AP–S International Symposium, Jun. 21–26, 1998, Atlanta, Gorgia, USA, vol. 2, pp. 908–911.

* cited by examiner

*Primary Examiner*—Don Wong
*Assistant Examiner*—James Clinger

(57) ABSTRACT

The invention relates to an antenna structure for radiating electromagnetic waves in predetermined polarization configurations. A dielectric substrate is provided with a copper conductive pattern printed on each side. The conductors act as scattering elements and are printed for scattering radiation provided along a first predetermined feed direction or alone a second feed direction independently. Preferably, the pattern of the copper is based on an interference pattern and two feeds are used, one to provide radiation along each of the two feed directions. When used as a traveling wave antenna, the resulting structure is flat, having a low profile, and lightweight with simple electronics. Improved isolation Occurs when the printed interference patterns each contain only a component along a single direction such that each scattering element is linear and is parallel to or orthogonal to other scattering elements.

31 Claims, 7 Drawing Sheets

Figure 14. H-plane co-polar pattern of circular-polarized two-layer dipole traveling-wave antenna at f = 28.2GHz

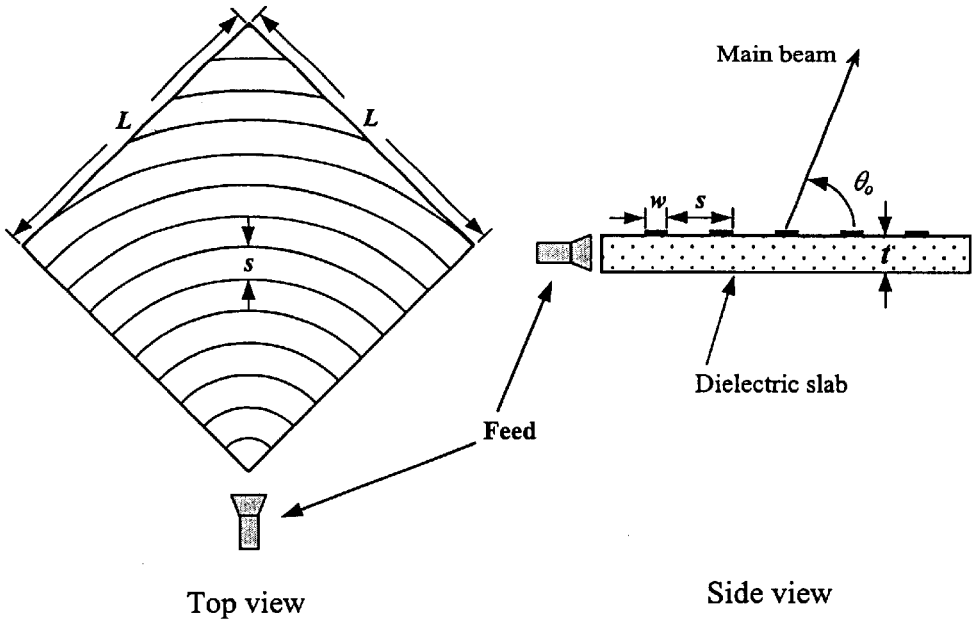
Figure 1. Linear-polarized continuous-arc traveling-wave antenna.
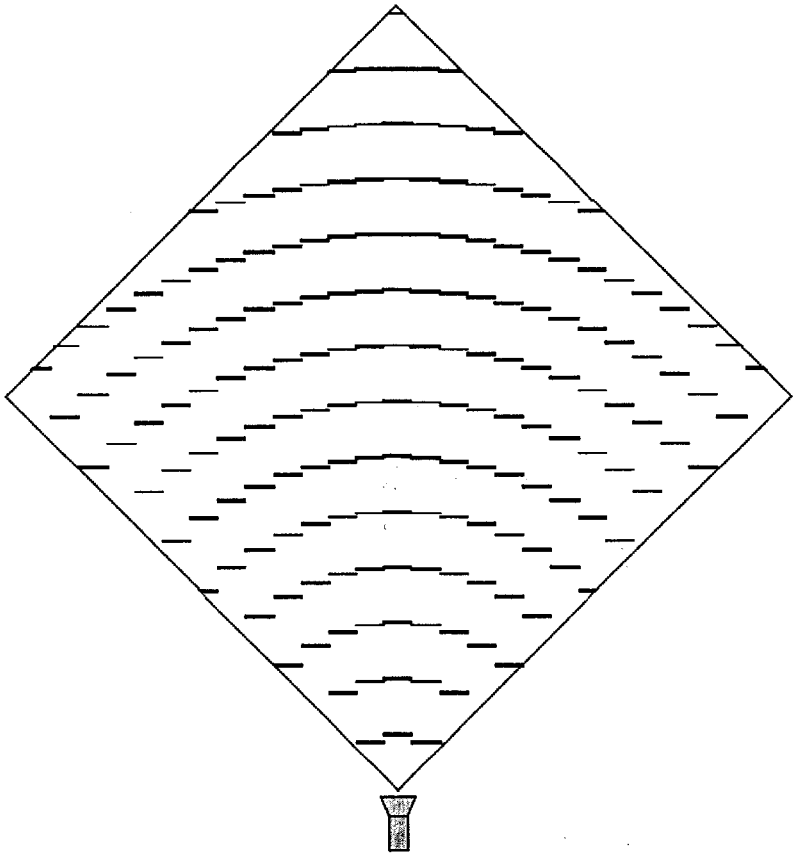
Figure 2. Linear-polarized dipole traveling-wave antenna.

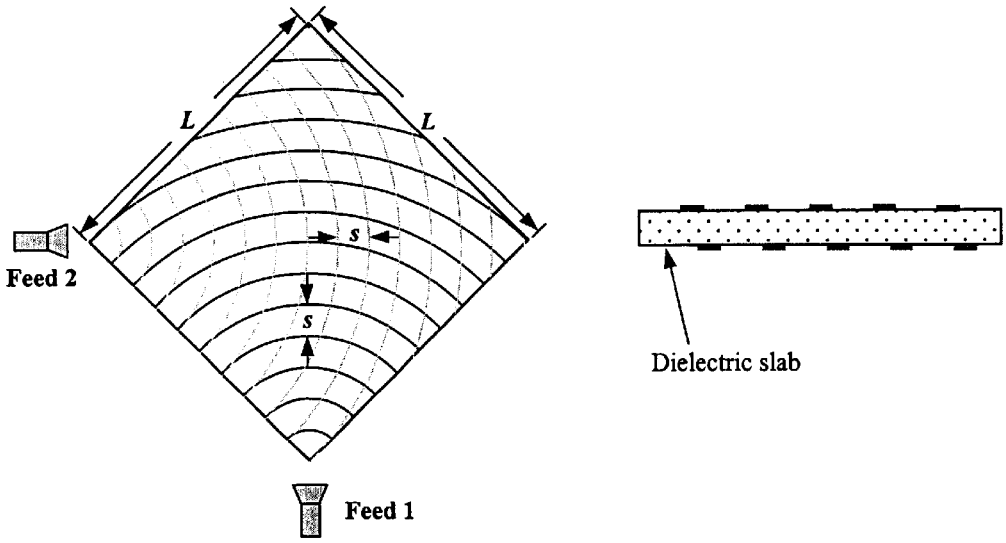
Figure 3. Dual-polarized continuous-arc traveling-wave antenna.
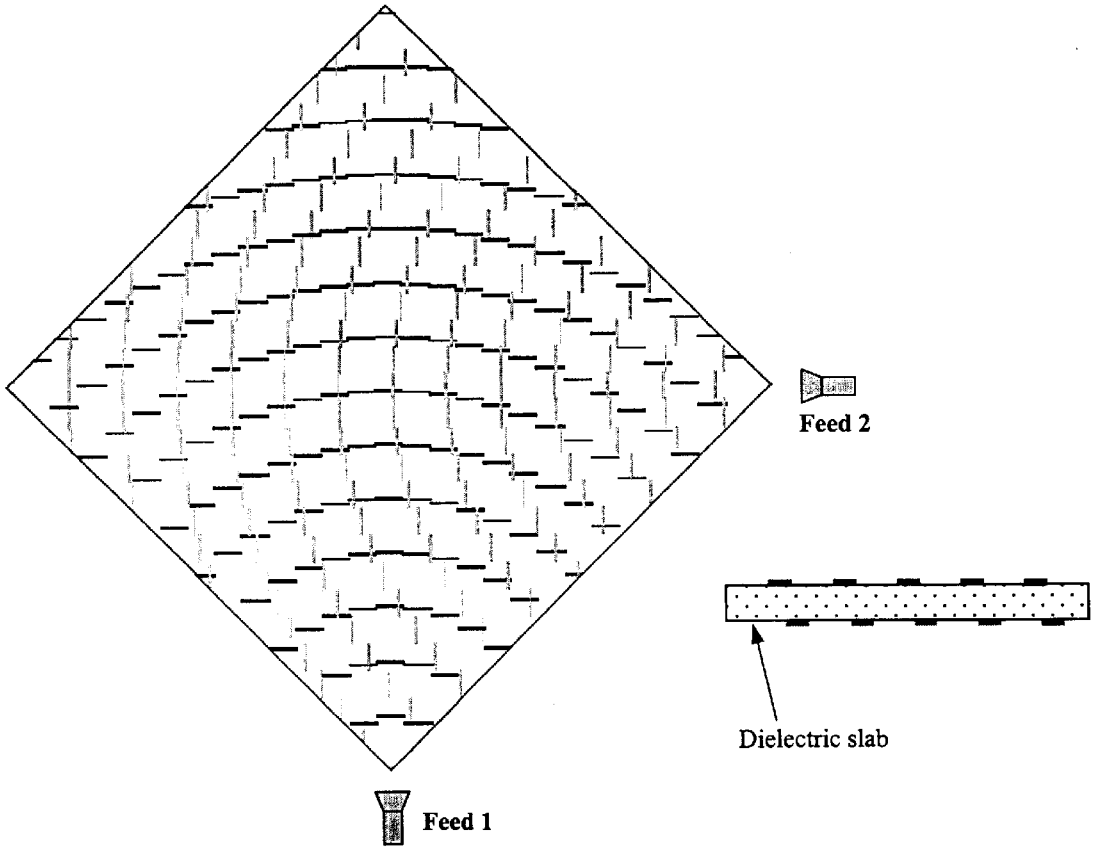
Figure 4. Dual-polarized dipole traveling-wave antenr

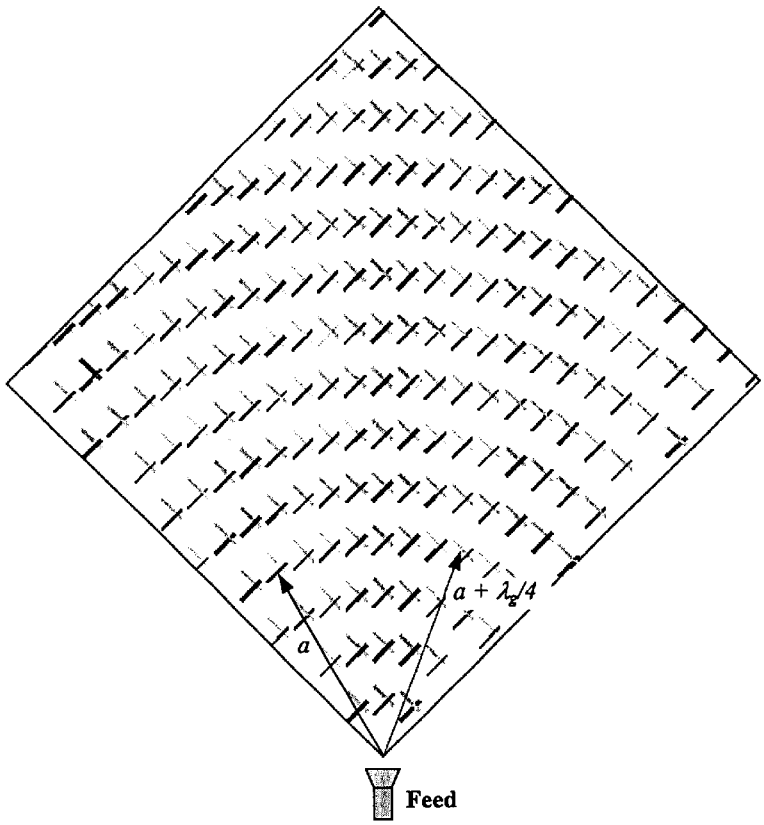
Figure 5. Circular-polarized dipole traveling-wave antenna.
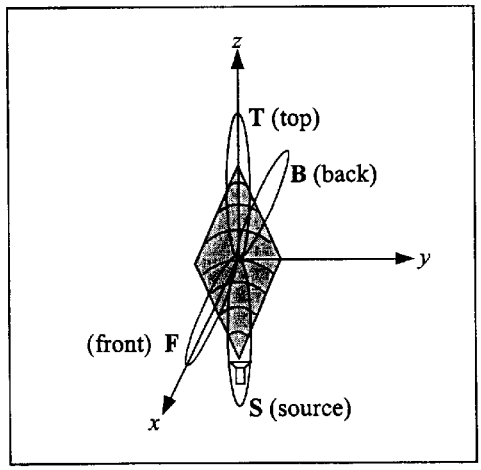
Figure 6. Radiation lobes with respect to the antenna.

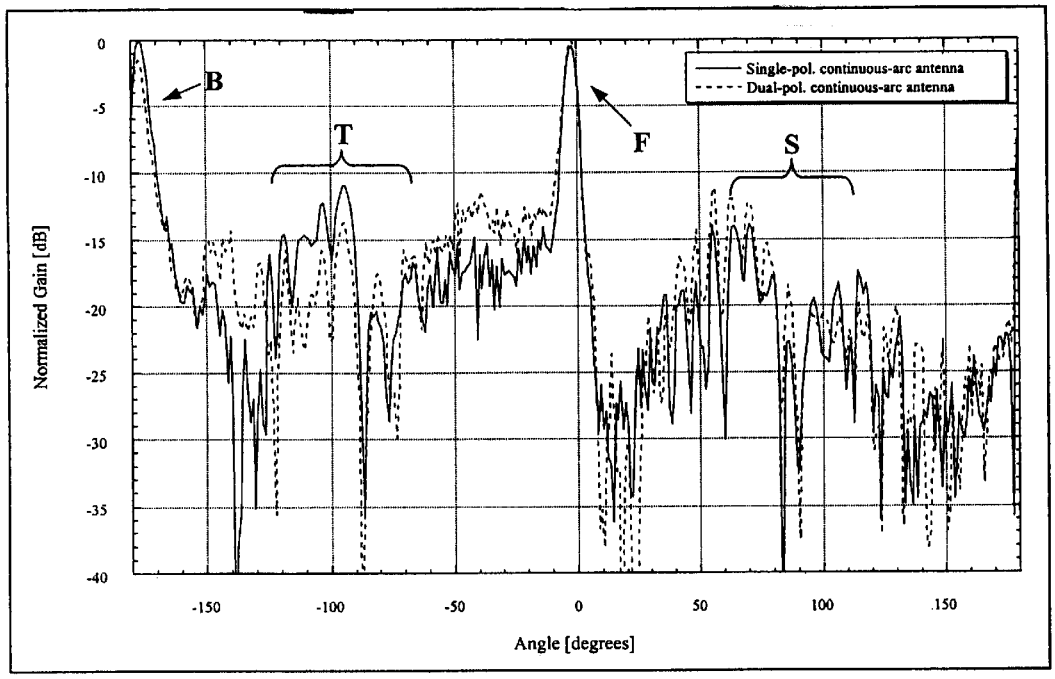
Figure 7. H-plane co-polar patterns of single and dual-polarized continuous-arc traveling-wave antennas at f = 30GHz
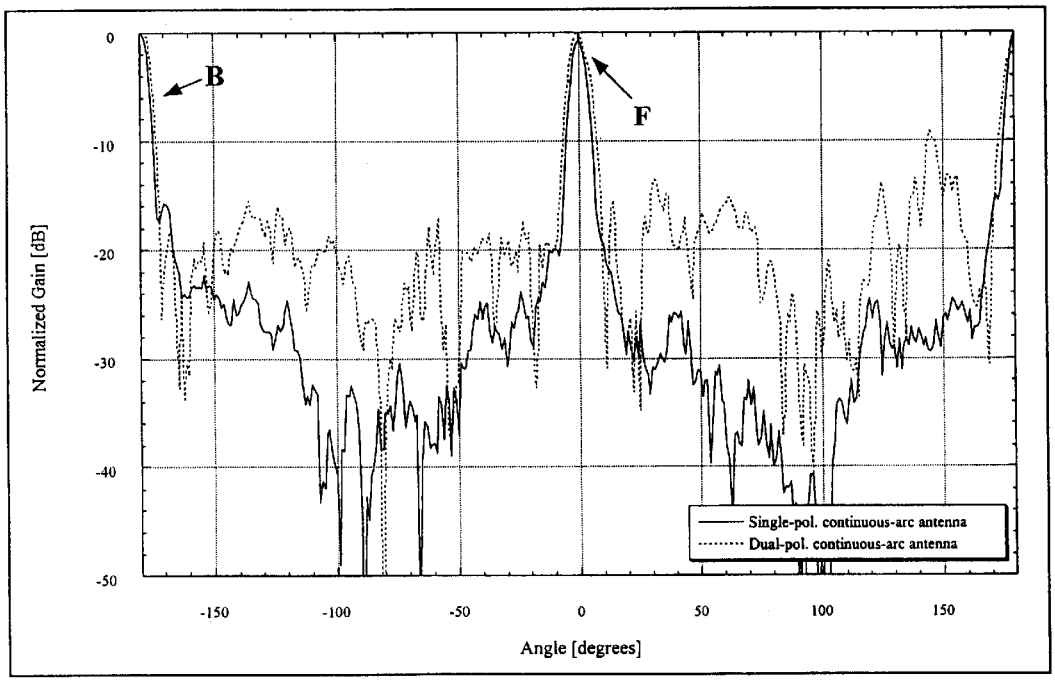
Figure 8. E-plane co-polar patterns of single and dual-polarized continuous-arc traveling-wave antennas at f = 28GHz

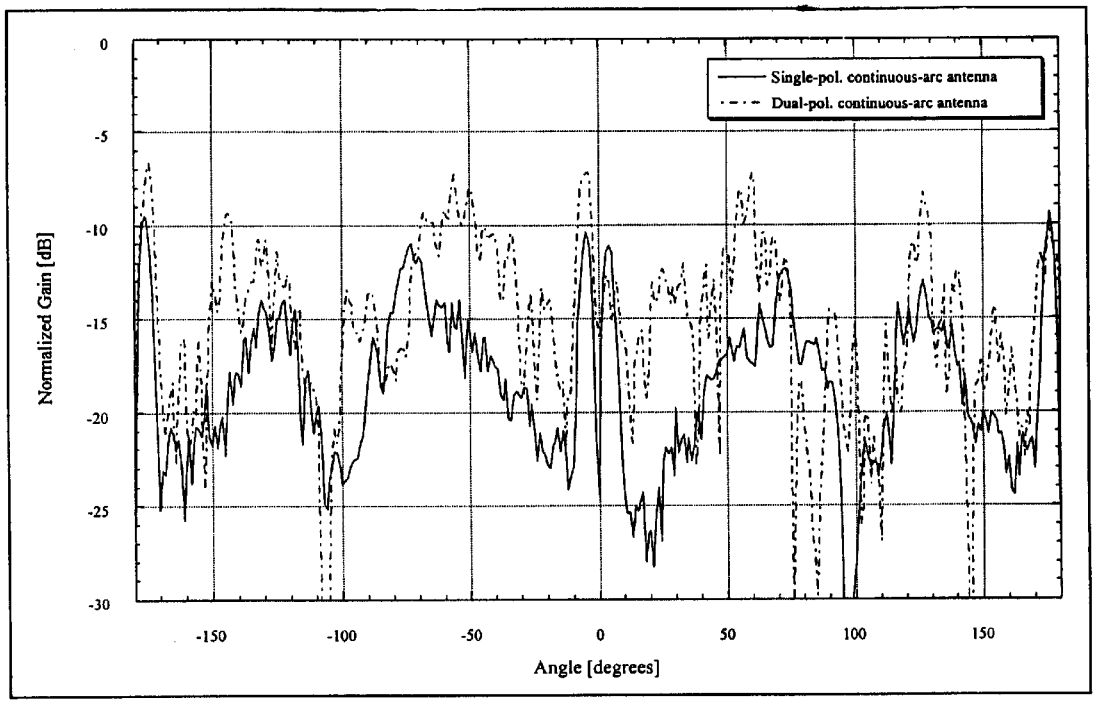
Figure 9. E-plane cross-polar patterns of single and dual-polarized continuous-arc traveling-wave antennas at f = 28GHz
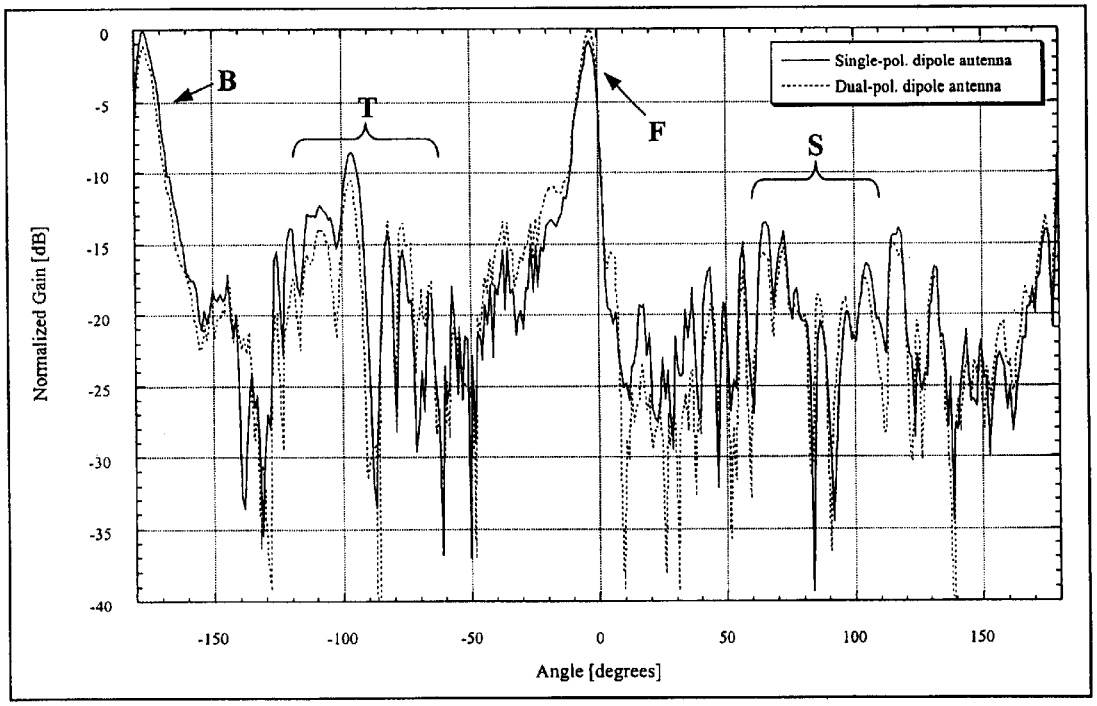
Figure 10. H-plane co-polar patterns of single and dual-polarized dipole traveling-wave antennas at f = 30GHz

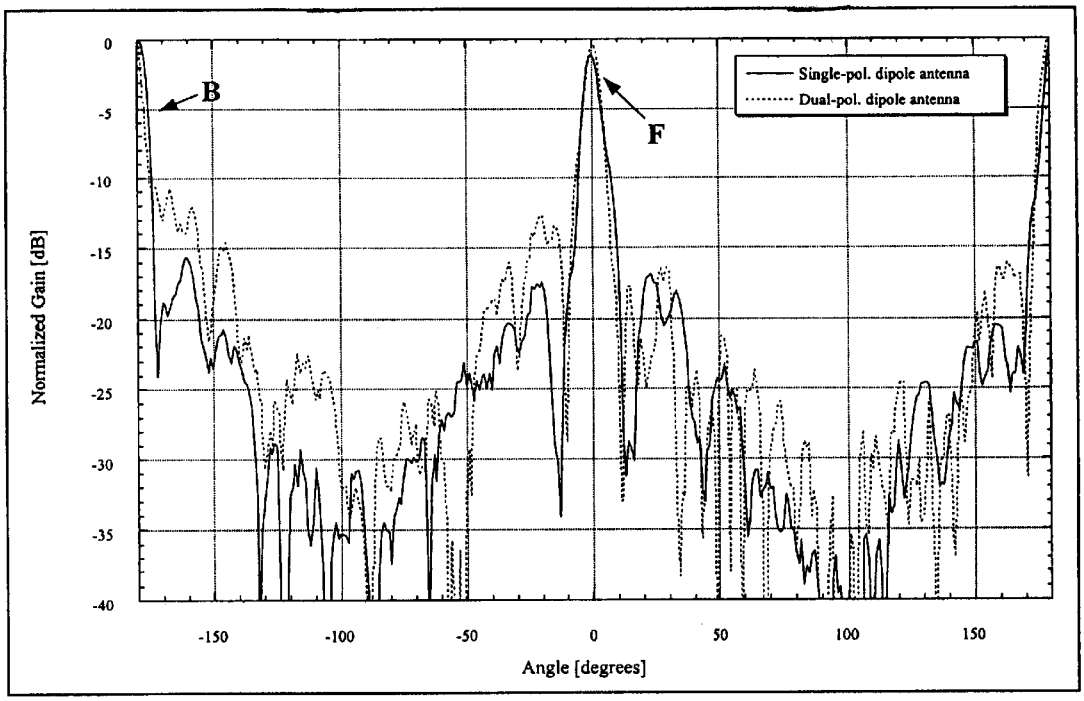
Figure 11. E-plane co-polar patterns of single and dual-polarized dipole traveling-wave antennas at f = 28GHz
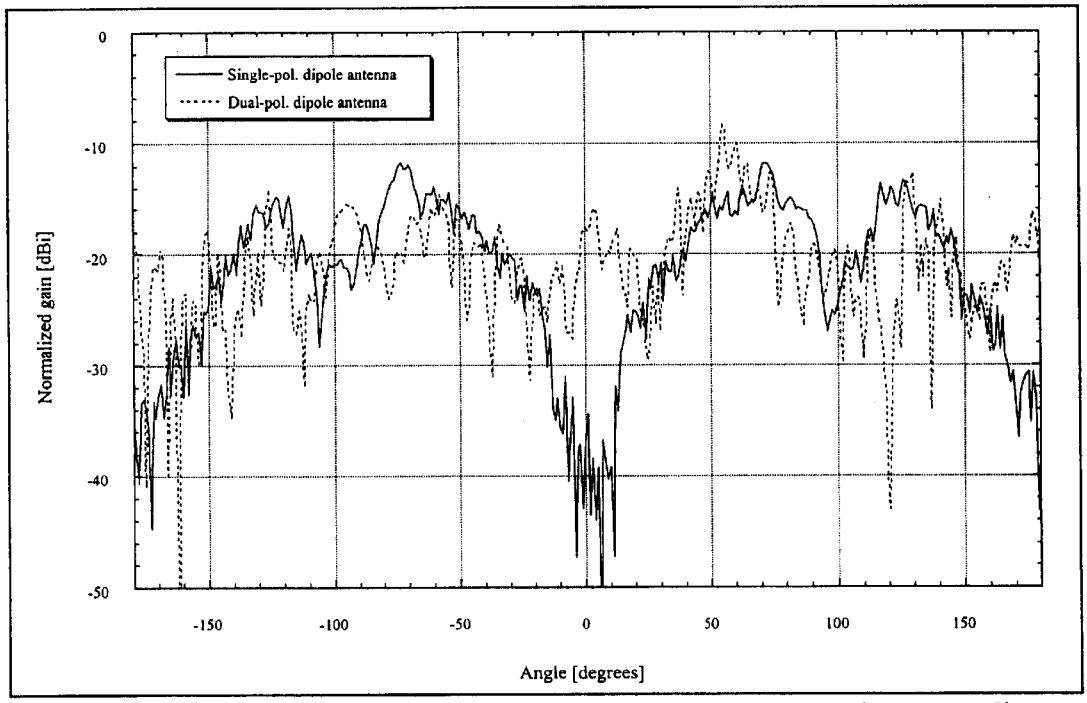
Figure 12. E-plane cross-polar patterns of single and dual-polarized dipole traveling-wave antennas at f = 28GHz

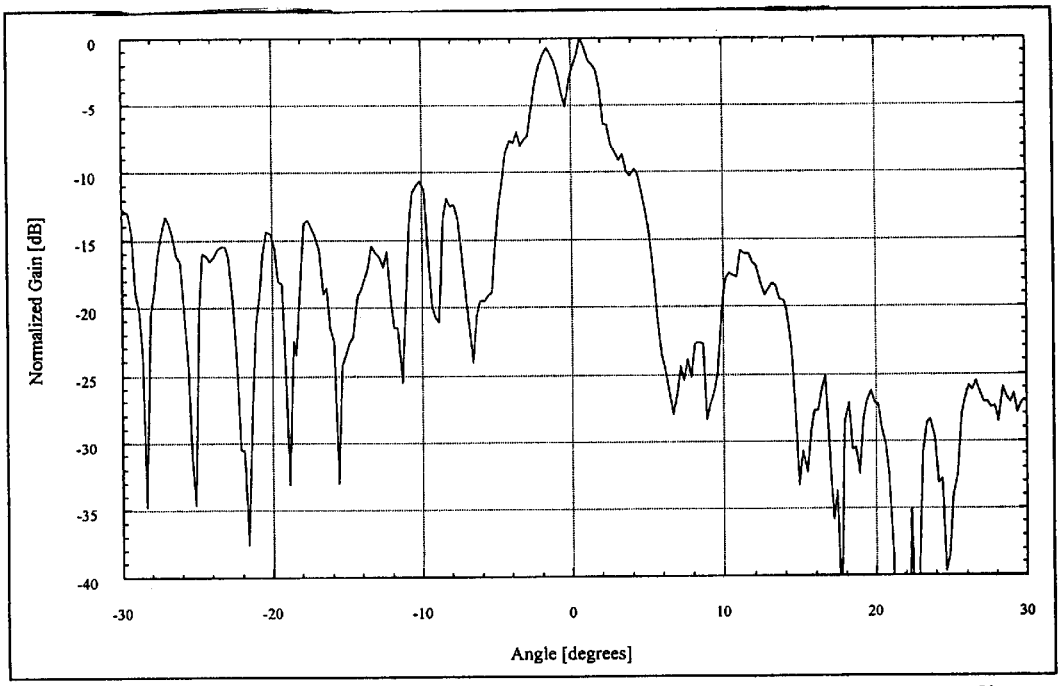
Figure 13. H-plane co-polar pattern of circular-polarized single-layer dipole traveling-wave antenna at f = 27.9GHz
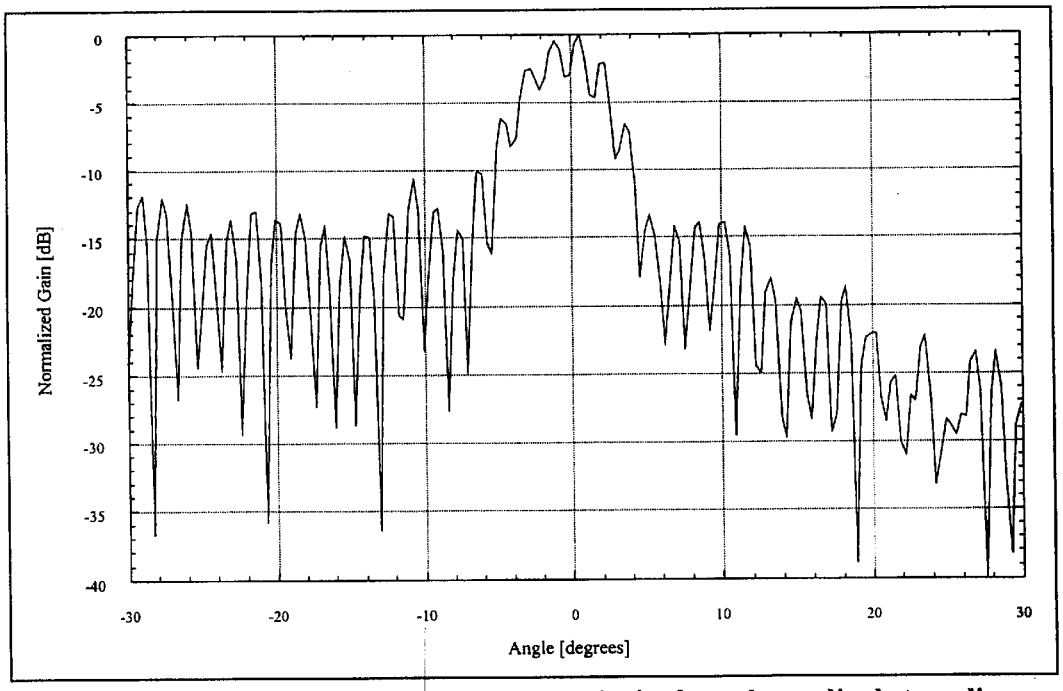
Figure 14. H-plane co-polar pattern of circular-polarized two-layer dipole traveling-wave antenna at f = 28.2GHz

DUAL-POLARIZED AND CIRCULAR-POLARIZED ANTENNAS

FIELD OF THE INVENTION

The invention relates generally to antennas and more particularly to antennas for providing polarized radiation designed based on holographic principles.

BACKGROUND OF THE INVENTION

Several new applications are emerging at Ka-band frequencies (26–40 GHz.) including Local Multi-point Communication/Distribution Systems (LMCS/LMDS) and advanced satellite communications systems (SATCOM). These systems must be capable of delivering high-bandwidth multimedia signals, therefore providing simultaneous services such as voice, fax, high-speed Internet access, videoconferencing, and many others. There is a strong requirement for these applications to increase channel capacity and to reduce interference due to impairments from obstacles such as rain, terrain variations, trees and buildings. A method of accomplishing this is through the use of dual and circular-polarized systems. Since these types of services are targeted for both business and home users, low-cost fixed or mobile user terminals are desirable to encourage widespread implementation. If the terminal is to be mounted on a house or on top of a car, then a low profile and lightweight design is preferred.

Traditionally when the above requirements are specified. high gain reflectors or reflect arrays are used due to their relatively high efficiency (up to 50%). For such a system, the feed is necessarily capable of supporting either dual or circular-polarization. This is also true with conventional lenses, which have efficiencies similar to those of reflectors. As well, passive microstrip phased arrays are employed for their low profile and multi-beam capabilities; however, passive microstrip phased arrays have less radiation efficiency. Reflectors and reflect arrays have a high profile, a heavy weight, and in many cases suffer from feed aperture blockage. An offset reflector configuration or a lens is often used to eliminate aperture blockage, resulting in increase size and/or complexity. Also, these systems require complex feeds to generate dual and circular-polarization in radiation emitted or reflected therefrom. Finally, these systems have a limited beam scan range for multi-beam applications unless a complicated surface shaping is applied. The disadvantage of low profile printed phased arrays is the high feed losses, which become significantly large at Ka-band and degrade the radiation efficiency. To compensate for these losses, amplifiers are added in the feed network, which increases the complexity and the cost, and may introduce additional problems such as oscillation and overheating. Presently active phased array antenna technology is being researched, particularly to achieve better dual and circular-polarization where isolation between polarization directions is often a limiting factor.

K. Iizuka et al. proposed a traveling wave antenna constructed based on holographic techniques in "Volume-Type Holographic Antenna", *IEEE Transactions of Antennas and Propagation*, vol. AP-23, November 1975, pp. 807–810. Effectively, a plurality of printed arcs on a substrate are irradiated from a source. The radiation is scattered in both directions. The use of a second similar printed substrate allows for radiation scattered behind the substrate to be scattered forward again in order to increase overall directionality and efficiency. In this cases the antenna disclosed therein provides a radiation pattern that is polarized in one direction.

Dual-polarized and circular-polarized traveling-wave antennas are known. Most of these antennas, such as those proposed in W. J. Getsinger, "Elliptically Polarized Leaky-Wave Array", *IRE Transactions on Antennas and Propagation*, vol. AP-10, March 1962, pp. 165–171 and A. Chan and M. Kharadly, "High Gain, Dual Frequency, Dual Polarization, Low Profile Antenna Design for Millimeter-Wave Communication Systems", *Tenth International Conference on Antenna and Propagation*, Apr. 14–17, 1997, Edinburgh, UK, pp. 1.390–1.393. are rectangular waveguiding structures with open apertures on one wall of the guide. Since these antennas are fast-wave structures, the practical radiated beam peak angle range is $10° \leqq \theta_0 \leqq 85°$ ($\theta_0$ is shown in FIG. 1). Therefore, broadside radiation ($\theta_0=90°$) and end-fire radiation ($\theta_0=0°$) is difficult to obtain with fast-wave antennas (also known as leaky-wave antennas).

The cylindrical DR rod antenna fed by a short helix to generate circular polarization described in H. T. Hui, Y. A. Ho, and E. K. N. Yung, "A Cylindrical DR Rod Antenna Fed by Short Helix", *IEEE AP-S International Symposium*, Jul. 21–26, 1996, Baltimore, Md., USA, vol. 3, pp. 1946–1949 is another interesting concept. However, the antenna only radiates end-fire because of the surface-wave mode it supports. There is also circularly polarized microstrip antennas such as Rampart-line and Chain traveling-wave arrays, but at millimeter-wave frequencies, these structures are very lossy. Another circularly polarized traveling-wave antenna, described in C. S. Lee and V. Nalbandian, "Circularly Polarized Traveling-Wave Microstrip Antenna", *IEEE AP-S International Symposium*, Jun. 21–26, 1998, Atlanta, Ga., USA, vol. 2, pp. 908–911 consists of a double-layer probe-fed microstrip half-circle that behaves as a leaky-wave transmission line. For high gain applications, an array of such elements requires a complex feed structure since each half-circle requires a probe. Also, phasing each element to scan the beam off broadside might significantly degrade the axial ratio at the beam peak due to the fix beam characteristic of the single element.

It would be advantageous to provide an antenna design based on holographic techniques that supports dual polarization and circular polarization.

It would be advantageous to provide a low profile light weight inexpensive antenna design for use in high frequency applications.

It would also be advantageous to provide a travelling wave antenna supporting dual or circular polarizations without requiring complex electronic circuitry.

Object of the Invention

In order to overcome these and other shortcomings of the prior art, it is an object of the present invention to provide an antenna that is capable of providing dual linear or circularly polarized radiation that is low profile and inexpensive to manufacture.

SUMMARY OF THE INVENTION

The dual and circular-polarized traveling-wave antennas of the invention overcome the above limitations by transforming a surface-wave mode to a leaky-wave mode or radiating-mode using a quasi-periodic grating structure or discontinuities. The antennas allow a radiated beam peak angle range of $0° \leqq \theta_0 \leqq 180°$ ($\theta_0=180°$ is called back-fire radiation) and only require a single linear-polarized feed to generate the pattern. Losses associated with microstrip antennas are minimal with the dual and circular-polarized traveling-wave antennas since only a little amount of copper is used.

In accordance with the invention there is provided an antenna comprising: a dielectric having first scattering elements disposed thereon in a first interference pattern for scattering radiation provided along first predetermined feed direction and second scattering elements disposed thereon in a second other interference pattern orthogonal to the first interference pattern for scattering radiation provided along a second predetermined feed direction, wherein during use a substantial amount of isolation exists between the radiation along the first feed and the second feed.

Preferably, the antenna is provided energy, fed, in two orthogonal directions from each of two feeds. Advantageously, the provided energy need not be polarized for the radiated energy to be polarized in a predetermined fashion. As such, the need for complex feed circuitry is obviated.

According to another embodiment the antenna comprises a first dielectric substrate comprising a plurality of first groups of linear scattering elements, each first group disposed in an arc, different first groups disposed along different arcs, linear scattering elements within the first groups each for scattering radiation with a predetermined polarization. Preferably, each group comprises a plurality of linear scattering elements forming a broken arc, broken in that the linear elements are each positioned on the arc to approximate the arc but, since they are linear, the resulting form is not a continuous arc.

In an embodiment the first dielectric substrate includes a plurality of second groups of linear scattering elements, each second group disposed along different arcs, the second groups for scattering radiation with a polarization orthogonal to the predetermined polarization.

In another embodiment the antenna comprises a dielectric substrate having scattering elements disposed thereon in an approximate interference pattern, the scatting elements parallel to a single plane for scattering radiation provided thereto from a feed disposed for radiating a traveling wave along the substrate into a radiation field having a single linear polarization.

In yet another embodiment the antenna comprises a first dielectric substrate having scattering elements disposed thereon in an interference pattern, the scatting elements parallel to a single plane for scattering radiation provided thereto into a radiation field having a single linear polarization and a first feed disposed to irradiate the dielectric for producing a linearly polarized radiation pattern scattered therefrom.

Antennas according to the invention combine the advantages of low-profile printed technology with an unconstrained feed to avoid excessive losses associated with conventional microstrip phased array feed networks. By varying the destructive interference pattern etched on a very thin dielectric slab it is also possible to design low-cost dual and circular-polarized traveling-wave antennas. Another interesting feature of these antennas is that optionally the feed is in the same plane as the dielectric slab, making the structure almost flat and preventing feed aperture blockages. Also, for designs for emitting circularly polarised radiation, these antennas to optionally use a simple linear polarized feed instead of a more complex circular-polarized feed required with conventional reflectors or lenses.

BRIEF DESCRIPTION OF THE DRAWINGS

The invention will now be described in conjunction with the attached drawings in which:

FIG. 1 is a simplified diagram of a linear-polarized continuous-arc traveling-wave antenna according to the prior art;

FIG. 2 is a simplified diagram of a linear-polarized dipole traveling-wave antenna according to the invention;

FIG. 3 is a simplified diagram of a dual-polarized continuous-arc traveling-wave antenna;

FIG. 4 is a simplified diagram of a dual-polarized dipole traveling-wave antenna;

FIG. 5 is a simplified diagram of a circular-polarized dipole traveling-wave antenna;

FIG. 6 is a simplified diagram illustrating radiation lobes with respect to the antenna;

FIG. 7 is a graph of H-plane co-polar patterns of single and dual-polarized continuous-arc traveling-wave antennas at f=30 GHz;

FIG. 8 is a graph of E-plane co-polar patterns of single and dual-polarized continuous-arc traveling-wave antennas at f=28 GHz;

FIG. 9 is a graph of E-plane cross-polar patterns of single and dual-polarized continuous-arc traveling-wave antennas at f=28 GH;

FIG. 10 is a graph of H-plane co-polar patterns of single and dual-polarized dipole traveling-wave antennas at f=30 GHz;

FIG. 11 is a graph of E-plane co-polar patterns of single and dual-polarized dipole traveling-wave antennas at f=28 GHz;

FIG. 12 is a graph of E-plane cross polar patterns of single and dual-polarized dipole traveling-wave antennas at f=28 GHz;

FIG. 13 is a graph of H-plane co-polar pattern of circular-polarized single-layer dipole traveling-wave antenna at f=27.9 GHz; and, FIG. 14 is a graph of H-plane co-polar pattern of circular-polarized two-layer dipole traveling-wave antenna at f=28.2 GHz.

DETAILED DESCRIPTION OF THE INVENTION

Referring to FIG. 1, a prior art traveling wave antenna is shown. Generally, all attempt to reproduce an interference pattern between a spherical wave and a plane wave printed on a dielectric is undertaken and then this is illuminated with a feed horn. The interference pattern is similar to that used in holography and, as such, this form of antenna is often referred to is holographic. The method was employed and tested to design several antennas.

The easiest pattern to reproduce was the destructive interference pattern (Intensity I=0). The intensity I is zero when the spherical wave and the plane wave are 180° out of phase, which means on the recording medium $\vec{E}_{SW}+\vec{E}_{PW}=0$ where $\vec{E}_{SW}$ is the electric field component of the spherical wave and $\vec{E}_{PW}$ is the electric field component of the plane wave. The tangential electric field component is known to be zero on an electric wall or a perfect conductor. Therefore, the destructive interference pattern between two waves can be reproduced by placing conducting strips where the intensity of the hologram is zero. These conducting strips can be etched onto a thin dielectric slab of thickness t as shown in FIG. 1. The resulting antenna structure has no ground plane and the feed horn is in a same plane as the dielectric slab. This holographic technique is applicable at any frequency range where a coherent source is available and therefore at all microwave frequencies.

The width w of the microstrip lines is chosen to be as small as possible in order to approach the ideal condition based on the interference pattern of infinitely narrow strips. Of course, wider microstrip lines may also be used when the performance provided thereby is sufficient. The thickness t of the dielectric slab is also very thin to reduce the effects of the dielectric on the surface wave, resulting in a very low profile antenna. The aperture size of the traveling-wave antennas is selected to meet the desired directivity.

From FIG. 1, the plane wave generated by the curved strips has both horizontal and vertical field components. The antenna's layout can be chosen to favor the horizontal polarization by simply cutting out from the destructive pattern the regions where the vertical component is predominant. Most of the remaining conducting arcs have a larger horizontal field component than a vertical one, and this "diamond" shaped hologram should help to reduce the cross-polarization level. Optionally, other shapes arc selected as long as the desired polarization is properly generated. A more effective way to construct the hologram, in terms of reducing the cross-polarization level, is to replace the continuous strips by an array of free-space dipoles as shown in FIG. 2. When the spherical wave hits the dipoles, only one polarization is intercepted, which was not the case with the continuous arcs where both polarization are intercepted thus increasing the cross-polarization level. Both configurations will exhibit a co-polarized radiation pattern similar to the one described in FIG. 6.

The behavior of the antennas was analyzed based on traveling-wave theory. Without any microstrip discontinuities, the dielectric slab only supports a surface wave generated by the feed horn. Adding a periodic grating on the surface of the slab transforms the surface wave into a leaky wave. This leaky wave, for a limited frequency band, will radiate with a radiated beam peak angle range of $0° \leqq \theta_0 \leqq 180°$, which is dependent on the frequency and the spacing s between the elements. The behavior of the leaky waive, or radiating mode, can be predicted with Floquet's Theorem. For broadside radiation at a desired frequency the spacing between the elements must be $s=\lambda_g$. Of course close approximations to $s=\lambda_g$ are sufficient in many cases. This spacing corresponds to the one predicted by the hologram theory when the plane wave interfering with the spherical wave is normally incident on the surface of the dielectric slab.

It has now been found that it is possible to place back-to-back two linear-polarized traveling-wave antennas to produce a dual-polarized traveling-wave antenna. The resulting antennas are shown in FIG. 3 for the continuous-arc case and FIG. 4 for the dipole case. The spherical wave generated by feed 1 will generate a radiating pattern that is horizontally polarized, and the spherical wave generated by feed 2 a radiation pattern that is vertically polarized.

Advantageously, such a design provides for a single aperture for the antenna. Further, the isolation achieved is substantial and therefore, there is no real advantage in providing two printed dielectric structures, one for each polarization. This is not apparent from the prior art. In particular, it is not apparent that the feed for generating vertically polarized radiation will not substantially effect the radiation emitted that is horizontally polarized—excellent isolation is provided—when joined in a single substrate. Because of the vertical components within the continuous arcs, it would seem likely that the isolation would be poor when a Single substrate is printed on opposite sides with orthogonal patterns wherein both sides are illuminated by orthogonally disposed feed horns. This is not the case. In fact, very good isolation results in the continuous arc antenna of FIG. 3. Even better isolation results from the dipole arc antenna of FIG. 4.

A radiation pattern that is circularly polarized is obtained by replacing the single dipoles in the linear-polarized dipole traveling-wave antenna by two orthogonal dipoles 90° out of phase as shown in FIG. 5. To obtain the phase difference between the orthogonal dipoles, the center of the black dipoles in FIG. 5 are placed at a radius $\alpha$ from the feed and the center of the gray dipoles at a radius $$a + \frac{\lambda_g}{4}.$$

The orthogonal dipoles were etched on the same layer in one test sample and on two layers back-to-back like the dual-polarized traveling-wave antennas in another test sample. For the two-layer structure, if a thick dielectric slab is used, the thickness of the slab is taken into account for the evaluation of the position of the gray dipoles with respect to the black ones. As for the polarization of the antenna, if the main lobe, F lobe in FIG. 6. generates left-hand circular polarization. the back lobe. B in FIG. 6, is right-hand circular polarization and vise versa.

All the above mentioned antennas were fabricated and tested. The dielectric constant of the slab was selected to be 3.38 with a thickness t=20 mils, and the antenna size was L=10 cm. Since for this slab the guided wavelength is approximately equal to the free-space wavelength, the spacing between the arcs is $s=\lambda_0$. The measured patterns for the dual-polarized continuous-arc traveling-wave antenna are shown in FIGS. 7 to 9. The measured patterns for the dual-polarized dipole traveling-wave antenna are shown in FIGS. 10 to 12. The measured patterns for the circular-polarized traveling-wave antennas are shown in FIGS. 13 and 14. The dual and circular-polarized antennas were not optimized for gain, but with an optimized linear-polarized traveling-wave antenna, it is possible to obtain an efficiency of 6%. Applying array theory on the linear-polarized antennas to suppress the back lobe (B) and the lobe towards the feed (S), an efficiency of 29% is known to be obtainable. For the dual-polarized antennas, the H-plane cross-polar isolation is better than 20 dB. Also, the isolation between the two polarizations is better than 30 dB for frequencies between 28 GHz and 32 GHz. The return loss oscillates between 5 dB and 10 dB, but is improved by suppressing the lobe towards the feed (S). The axial ratio near broadside of the circular-polarized single-layer dipole traveling-wave antenna is 4.4 dB, and of the circular-polarized two-layer dipole traveling-antenna is 2.1 dB. The return loss is better than 10 dB for frequencies between 29.2 GHz and 32 GHz for the circular-polarized single-layer antenna and better than 10 dB for frequencies between 30 GHz and 32 GHz for the circular-polarized two-layer antenna.

When directionality of the antenna is of concern, a second substrate having a similar dispersive pattern to a side of the first substrate is positioned behind the first substrate. Such a substrate acts to disperse radiation behind the substrate in a direction toward the substrate thereby increasing the radiation in the direction forward of the substrate. The placement and characteristics of such a second substrate is known in the art. The use of the second substrate is generally dispersive of radiation with a polarisation that is dispersed by the scattering elements thereon and somewhat transparent to other radiation. Therefore, a third substrate positioned on an opposing side of the first substrate is also possible.

Optionally, the feed horn is placed in front of the dielectric slab or offset therefrom. This results in an antenna structure other than a traveling wave antenna but retains most of the advantages of the present invention and function mostly in accordance with the present disclosure.

Further optionally, dielectric material is used in place of printed conductive material to form scattering elements on the substrate. The substitution of one scattering element for another is a matter of experimentation that can be performed by one of skill in the art based on the present disclosure.

Numerous other embodiments may be envisioned without departing from the spirit or scope of the invention.

What is claimed is:

1. An antenna comprising:

a dielectric having first scattering elements disposed thereon in a first interference pattern for scattering radiation provided along first predetermined feed direction and second scattering elements disposed thereon in a second other interference pattern orthogonal to the first interference pattern for scattering radiation provided along a second predetermined feed direction, the second scattering elements being disposed such that there is no direct physical contact between the second scattering elements and the first scattering elements, and wherein during use as a traveling wave antenna a substantial amount of electromagnetic isolation exists between the radiation along the first feed direction and the second feed direction.

2. An antenna according to claim 1 wherein the dielectric is a flat thin dielectric substrate having two opposing sides and wherein the first scattering elements are disposed on a first side of the dielectric substrate and wherein the second scattering elements are disposed on a second opposing side of the dielectric substrate.

3. An antenna according to claim 2 comprising a first feed for directing radiated energy toward the dielectric along the first predetermined direction; and, a second feed for directing radiated energy toward the dielectric along the second predetermined direction.

4. An antenna according to claim 3 wherein the first feed is positioned for generating a traveling wave.

5. An antenna according to claim 3 wherein the first feed is offset from the dielectric substrate for generating a space wave.

6. An antenna according to claim 3 wherein the scattering elements on opposing sides are each for scattering radiation from an associated feed with a linear polarization, the scattering elements on opposing sides for scattering radiation with two orthogonal polarities, resulting during use in radiation of dual linear polarisation.

7. An antenna according to claim 3 wherein the scattering elements on opposing sides are each for scattering radiation from an associated feed with a linear polarization, the scattering elements on opposing sides for scattering radiation in two orthogonal polarities and spaced in relation to a phase of the radiation for scattering during use radiation of circularly polarized nature.

8. An antenna according to claim 1 comprising a first feed for directing radiated energy toward the dielectric along the first predetermined direction.

9. An antenna according to claim 8 comprising a second feed for directing radiated energy toward the dielectric along the second predetermined direction.

10. An antenna according to claim 1 wherein the dielectric is a flat thin dielectric substrate having two opposing sides and wherein the first scattering elements are disposed on a first side of the dielectric substrate and wherein the second scattering elements are disposed on the first side of the dielectric substrate.

11. An antenna according to claim 10 wherein the first and second scattering elements scatter radiation from an associated feed with relatively orthogonal polarization and are spaced in relation to a phase of the radiation for scattering, during use, radiation of circularly polarized nature.

12. An antenna according to claim 1 comprising a second dielectric substrate disposed spaced from the first dielectric substrate and similar to the first dielectric substrate but having scattering elements disposed on one side for scattering radiation toward the first dielectric substrate.

13. An antenna according to claim 1 wherein the scattering element are formed of conductive material printed on the substrate.

14. An antenna according to claim 13 wherein the scattering element are each linear scattering elements.

15. An antenna according to claim 13 wherein the scattering element are dual linear scattering elements in an "L" form, the linear portions of a single scattering element being orthogonal one to the other.

16. An antenna according to claim 1 wherein the scattering element are formed of dielectric resonators disposed on the substrate.

17. An antenna comprising:

a first dielectric substrate comprising a plurality of first groups of linear scattering elements, each first group disposed in an arc, different first groups disposed along different arcs, the first groups for scattering radiation with a predetermined polarization.

18. An antenna according to claim 17 wherein the first dielectric substrate comprises a plurality of second groups of linear scattering elements, each second group disposed along different arcs, the second groups for scattering radiation with a polarization orthogonal to the predetermined polarization.

19. An antenna according to claim 18 wherein the first groups and the second groups are disposed on opposing sides of the first dielectric substrate.

20. An antenna according to claim 17 wherein the first dielectric substrate comprises a plurality of second groups of linear scattering elements, each second group disposed along same arcs, the second groups for scattering radiation with a polarization orthogonal to the predetermined polarization, wherein the second groups of linear scattering elements are orthogonal to the first groups of linear scattering elements.

21. An antenna according to claim 20 wherein the first groups and the second groups are relatively spaced therebetween for, during use, scattering radiation with circular polarization.

22. An antenna according to claim 18 comprising a first feed and a second feed, the first and second feeds for radiating energy toward the first dielectric substrate in approximately orthogonal feed directions.

23. An antenna comprising:

a first dielectric substrate having scattering elements disposed thereon in an interference pattern, the scattering elements parallel to a single plane for scattering radiation provided thereto from a feed disposed for radiating a traveling wave along the substrate into a radiation field having a single linear polarization.

24. An antenna as defined in claim 23 comprising:

a first feed disposed to irradiate the dielectric for producing a linearly polarized radiation pattern scattered therefrom.

25. An antenna according to claim 24 wherein the scattering elements are disposed in arcs about a location of the first feed.

26. An antenna according to claim 25 wherein the scattering elements are linear and are disposed parallel one to another and form broken arcs.

27. An antenna according to claim 26 wherein the scattering elements are perpendicular to a tangent at a point within the formed arc.

28. An antenna according to claim 24 comprising a second dielectric substrate having scattering elements disposed thereon in an interference pattern, the scatting elements for scattering most radiation provided thereto into a radiation field having a single linear polarization, the second dielectric substrate spaced from the first substrate and disposed for scattering some of the radiation received back toward the first substrate.

29. An antenna according to claim 28 wherein the scattering elements on the second dielectric substrate are each disposed parallel to a same single plane.

30. An antenna according to claim 29 wherein the second dielectric substrate is identical to the first dielectric substrate.

31. An antenna according to claim 24 wherein the scattering elements on the second dielectric substrate are each in the form of a curved arc.

* * * * *